US010173334B2

(12) United States Patent
Woolery

(10) Patent No.: US 10,173,334 B2
(45) Date of Patent: Jan. 8, 2019

(54) MAGNETIC UTILITY KNIFE AND HOLDER

(71) Applicant: Andre A. Woolery, Miami, FL (US)

(72) Inventor: Andre A. Woolery, Miami, FL (US)

(73) Assignee: MagnoGrip Inc., Miami, FL (US)

( * ) Notice: Subject to any disclaimer, the term of this patent is extended or adjusted under 35 U.S.C. 154(b) by 379 days.

(21) Appl. No.: 14/266,510

(22) Filed: Apr. 30, 2014

(65) Prior Publication Data

US 2014/0325847 A1 Nov. 6, 2014

Related U.S. Application Data

(60) Provisional application No. 61/819,278, filed on May 3, 2013.

(51) Int. Cl.
*B26B 29/02* (2006.01)
*B26B 1/10* (2006.01)

(52) U.S. Cl.
CPC ..... *B26B 29/025* (2013.01); *B26B 1/10* (2013.01)

(58) Field of Classification Search
CPC ..... B26B 1/00–1/10; B26B 3/00–3/08; B26B 5/00–5/008; B26B 11/00–11/008; B26B 29/00–29/025
USPC ..... 30/152–162
See application file for complete search history.

(56) References Cited

U.S. PATENT DOCUMENTS

| | | | | |
|---|---|---|---|---|
| 178,611 A | | 6/1876 | Dye | |
| 625,423 A | | 5/1899 | Scriven et al. | |
| D59,955 S | | 12/1921 | Farnham | |
| 1,724,069 A | | 8/1929 | Butera | |
| 2,212,326 A | | 8/1940 | Piken Irving | |
| 2,456,445 A | | 12/1948 | Rees et al. | |
| 2,597,601 A | | 5/1952 | Sherman | |
| 2,910,804 A | * | 11/1959 | White | F41C 33/0263 2/300 |
| 3,007,568 A | | 11/1961 | Kurland | |
| 3,008,617 A | * | 11/1961 | Villwock | F41C 33/0209 224/183 |
| 3,161,932 A | | 12/1964 | Seymour | |

(Continued)

FOREIGN PATENT DOCUMENTS

| | | | |
|---|---|---|---|
| FR | 2747274 A1 | | 10/1997 |
| FR | 2774619 A1 | * | 8/1999 |
| FR | 2914872 A1 | * | 10/2008 |

OTHER PUBLICATIONS

Lee Valley & verítas®, Fine Woodworking Tools 2001/2002, Magnetic Tape Holder.*

(Continued)

*Primary Examiner* — Jason Daniel Prone
(74) *Attorney, Agent, or Firm* — Haverstock & Owens LLP

(57) ABSTRACT

A utility knife includes a body with a knife blade storable within the body and one or more magnets coupled to the knife body. The magnets are able to be embedded within the body or embedded with an adapter that is configured to removably couple with the utility knife. In some embodiments, the knife blade folds out from a side of the body and into an operable position. Alternatively, in some embodiments, the knife blade slides out of a top of the body and into the operable position. The utility knife is able to magnetically couple with a base having a magnetically attractable surface. The utility knife is securable to the base in a vertical orientation and a horizontal orientation.

16 Claims, 9 Drawing Sheets

(56) References Cited

U.S. PATENT DOCUMENTS 3,180,641 A 4/1965 Shane
3,220,018 A 11/1965 Johnson
3,256,529 A 6/1966 Panepinto
3,298,579 A 1/1967 Smith
D221,412 S * 8/1971 Laughlin ..... D8/99
3,886,508 A 5/1975 Lavrad
3,933,286 A 1/1976 Karkas
D238,821 S 2/1976 Romani
3,943,912 A 3/1976 Nakayama
D240,901 S 8/1976 Unger
3,997,092 A 12/1976 Pogwizd
4,068,784 A 1/1978 Angell
4,069,954 A 1/1978 Rauch
4,103,779 A 8/1978 Wagner
D249,939 S 10/1978 Dammons
D252,541 S 8/1979 Harper
4,182,470 A 1/1980 Atkinson
D256,512 S 8/1980 Sims
4,317,284 A * 3/1982 Prindle ..... A47G 21/06 30/147
D267,555 S 1/1983 Cox
4,389,775 A * 6/1983 Collins ..... A44B 11/005 30/151
D271,911 S 12/1983 Hunt
4,432,477 A 2/1984 Haidt et al.
4,480,596 A 11/1984 Shumiyashu
4,481,712 A * 11/1984 Phelps ..... B26B 1/02 30/151
4,498,612 A * 2/1985 Geekie, Jr. ..... A44B 11/005 24/163 R
4,544,076 A 10/1985 Miller
4,587,956 A 5/1986 Griffin et al.
D288,076 S 2/1987 Wheeler
4,662,070 A * 5/1987 Reddig ..... B26B 5/005 30/125
4,715,839 A * 12/1987 Ford ..... A44B 11/001 24/163 K
4,754,528 A 7/1988 Lyons et al.
4,826,059 A 5/1989 Bosch et al.
4,858,800 A 8/1989 Holtzclaw, Jr. et al.
4,917,644 A 4/1990 Sunshine
4,941,260 A * 7/1990 Castelluzzo ..... B26B 5/001 30/162
4,942,663 A * 7/1990 Ray, Sr. ..... B26B 29/025 30/162
5,018,653 A 5/1991 Shoemaker
D317,402 S 6/1991 Segal
D317,730 S 6/1991 Mo
5,025,966 A 6/1991 Potter
5,163,566 A * 11/1992 Hempel ..... A47K 1/09 211/DIG. 1
5,199,621 A 4/1993 McLennan
5,213,240 A 5/1993 Dietz et al.
5,217,150 A * 6/1993 Chen ..... A44B 11/005 30/151
5,236,113 A 8/1993 Wisser
5,301,428 A * 4/1994 Wilcox ..... B26B 5/001 30/162
5,333,767 A 8/1994 Anderson
5,341,975 A 8/1994 Marinescu
D354,667 S * 1/1995 Rundell ..... D8/98
5,385,281 A 1/1995 Byrd
5,388,740 A 2/1995 Garland
D364,955 S 12/1995 Gringer et al.
5,484,057 A 1/1996 Tzu-Ching
5,513,405 A * 5/1996 Bradbury, Jr. ..... B26B 5/00 30/123
D372,878 S 8/1996 Finnegan
5,584,423 A 12/1996 Wang
5,592,742 A * 1/1997 Okamura ..... B26B 5/00 30/254
5,593,073 A 1/1997 Finnegan
5,623,735 A 4/1997 Perry
5,630,242 A * 5/1997 Oginaezawa ..... B26B 27/00 30/294
5,632,426 A 5/1997 Beletsky et al.
5,642,847 A 7/1997 Demeo et al.
D386,381 S * 11/1997 Black ..... D8/99
5,707,333 A 1/1998 Bakst
5,758,807 A 6/1998 Wright
5,782,743 A 7/1998 Russell
5,820,000 A 10/1998 Timberlake et al.
5,894,971 A 4/1999 Huang
5,950,239 A 9/1999 Lopez
5,984,046 A 11/1999 Urso, Jr.
5,989,101 A 11/1999 Jenn-Shyang et al.
6,006,365 A 12/1999 Strandberg
6,006,906 A 12/1999 Winnard
6,049,914 A 4/2000 Heilman
D426,640 S 6/2000 Bell et al.
6,093,143 A 7/2000 Nagler
D432,412 S 10/2000 Gamboa
6,125,475 A 10/2000 Taylor
6,195,898 B1 * 3/2001 Lemisch ..... B26B 1/04 30/153
6,205,667 B1 * 3/2001 Glesser ..... B26B 1/08 30/162
6,219,869 B1 * 4/2001 Burba ..... B26B 11/001 7/118
6,267,277 B1 7/2001 Taylor
6,325,577 B1 12/2001 Anderson
6,330,961 B1 12/2001 Borja
6,332,862 B1 12/2001 Zandman
6,336,555 B1 1/2002 Breeden
6,382,482 B1 * 5/2002 Chao ..... B60R 7/05 224/183
6,401,253 B2 6/2002 Brunson
6,405,381 B1 6/2002 Bowman
6,406,418 B1 6/2002 Getek
6,457,239 B1 * 10/2002 McLaughlin ..... B26B 29/025 30/151
6,457,252 B1 10/2002 Kershner
6,481,017 B2 11/2002 Mullis
6,530,508 B1 3/2003 Devine
6,561,402 B2 5/2003 Holland et al.
6,571,997 B2 6/2003 Dedrick
6,587,022 B1 7/2003 Devine
6,610,023 B2 8/2003 Steponovich
6,643,845 B2 11/2003 O'Dea et al.
6,658,756 B1 12/2003 Sanchez, Jr.
6,675,965 B2 1/2004 Holland
6,719,178 B1 4/2004 Taylor
6,779,199 B1 8/2004 O'Dea et al.
D495,939 S * 9/2004 Ping ..... D8/99
6,796,344 B2 9/2004 Chen et al.
6,824,028 B2 11/2004 Mutai et al.
6,836,899 B1 1/2005 Glasmire
6,888,940 B1 5/2005 Deppen
6,925,656 B2 8/2005 Henderson
D509,724 S * 9/2005 Cook ..... D8/99
6,964,361 B2 11/2005 Kathrein
7,000,732 B1 2/2006 Briggs, Jr.
7,003,833 B2 * 2/2006 Feliciano ..... B25F 1/04 30/155
7,048,162 B2 5/2006 Frye et al.
7,076,885 B2 7/2006 Potter
7,111,402 B1 * 9/2006 Pearman ..... B26B 1/04 30/151
7,124,921 B1 10/2006 Hubbell
7,146,651 B1 12/2006 Lapin
7,337,903 B2 3/2008 Lauri
7,373,696 B2 5/2008 Schoening et al.
D581,240 S * 11/2008 Glesser ..... D8/99
7,490,724 B2 2/2009 Week et al.
D611,678 S 3/2010 Bailey
7,934,610 B2 * 5/2011 Zeng ..... A47G 21/14 211/70.7
8,006,391 B1 * 8/2011 Mashburn ..... B26B 5/00 30/156
D663,115 S * 7/2012 Hansen ..... D3/228

(56) References Cited

U.S. PATENT DOCUMENTS 8,317,067 B2 * 11/2012 Lewis ..... A45F 5/02 224/183
8,403,140 B2 * 3/2013 Woolery ..... A47F 7/00 206/350
8,418,971 B2 * 4/2013 Rayko ..... A47G 21/14 248/37.6
8,499,986 B2 8/2013 Knight et al.
8,516,621 B2 * 8/2013 Woolery ..... A41D 13/0012 2/300
8,726,525 B2 * 5/2014 Bagley ..... A47J 17/02 30/279.2
8,931,179 B2 * 1/2015 Powell ..... B26B 3/00 30/143
8,936,222 B1 * 1/2015 Bastian ..... A45F 5/00 224/183
9,216,503 B2 * 12/2015 Lawrence ..... B26B 5/001 7/138
9,379,759 B2 * 6/2016 Platt ..... H04B 1/3888 455/550.1
9,616,821 B2 * 4/2017 Elharar ..... B60R 11/0241 248/230.8
2001/0054630 A1 12/2001 Crabill
2002/0104151 A1 8/2002 Rauscher
2002/0113105 A1 8/2002 Jarman
2002/0175100 A1 11/2002 Holland et al.
2002/0175131 A1 * 11/2002 Johnson ..... A47G 21/14 248/37.3
2003/0052143 A1 3/2003 Devine
2003/0197042 A1 10/2003 Warren
2003/0230606 A1 12/2003 Devine
2004/0173484 A1 9/2004 Bates et al.
2004/0178236 A1 9/2004 Kakouras
2005/0035164 A1 2/2005 Badillo
2005/0040194 A1 2/2005 Frye et al.
2005/0082323 A1 4/2005 O'Hair
2005/0102845 A1 * 5/2005 Dallas ..... B25F 1/02 30/308.1
2005/0132578 A1 * 6/2005 Colich ..... B23D 51/025 30/293
2005/0263550 A1 12/2005 Williams
2006/0011679 A1 1/2006 Santiago
2006/0016841 A1 1/2006 Shurm
2006/0027613 A1 2/2006 Chang
2006/0032876 A1 2/2006 Goffinet
2006/0102678 A1 5/2006 Bommarito
2006/0207102 A1 * 9/2006 Bezold ..... B26B 1/08 30/162
2006/0218810 A1 10/2006 Holevas
2006/0261113 A1 11/2006 Godshaw et al.
2006/0272076 A1 12/2006 Schroeder
2007/0006367 A1 1/2007 Newman et al.
2007/0099469 A1 5/2007 Sorensen
2007/0180726 A1 8/2007 Harrell
2007/0199426 A1 8/2007 Tafolla
2007/0261174 A1 * 11/2007 Barker ..... B26B 5/00 7/160
2008/0016699 A1 * 1/2008 Chang ..... F41B 13/04 30/151
2008/0060204 A1 * 3/2008 Chen ..... A47G 21/14 30/298.4
2008/0185414 A1 8/2008 Conlon
2008/0283563 A1 11/2008 O'Donnell et al.
2009/0044419 A1 2/2009 Lee et al.
2009/0050657 A1 * 2/2009 Woolery ..... A45F 3/14 224/183
2009/0095785 A1 * 4/2009 Woolery ..... A41D 13/0012 224/665
2009/0127146 A1 5/2009 Krebs et al.
2009/0140016 A1 6/2009 Case et al.
2009/0194571 A1 8/2009 Evans
2009/0289089 A1 11/2009 Fullerton et al.
2009/0289090 A1 11/2009 Fullerton et al.
2009/0314813 A1 * 12/2009 Woolery ..... A45F 5/02 224/183
2010/0193557 A1 8/2010 Clinton et al.
2010/0293791 A1 * 11/2010 Mueller ..... B25G 1/102 30/162
2011/0083254 A1 4/2011 Trutuna et al.
2012/0017442 A1 * 1/2012 King ..... B26B 1/02 30/155
2012/0042520 A1 * 2/2012 Simeray ..... B26B 3/00 30/143
2013/0047455 A1 2/2013 Steele et al.
2013/0167381 A1 * 7/2013 Kommer ..... B26B 1/044 30/161
2013/0200117 A1 8/2013 Monro et al.
2014/0173914 A1 * 6/2014 Yu Chen ..... B26B 3/00 30/278
2014/0338197 A1 * 11/2014 Frazer ..... B26B 29/025 30/151
2015/0245726 A1 * 9/2015 Henry ..... B26B 11/00 99/506

OTHER PUBLICATIONS www.dickblick.com BLICK art materials, "Super Brush Holder", 2 pages.
www.dickblick.com BLICK art materials, "Q-Grip Canvas Grip Brush Organizer", 2 pages.
www.dickblick.com BLICK art materials, "Loew Cornell Brush Organizer", 2 pages.
www.dickblick.com BLICK art materials, "Prat Start Brush Ease", 1 page.
www.dickblick.com BLICK art materials, "Canvas Brush Organizer", 2 pages.
www.dickblick.com BLICK art materials, "Blick Hanging Closet Organizer", 2 pages.
http://www.artmakers.com/magneto.
http://www.buildingonline.com/news.
http://www.smarthome.com/89091.
http://www.diynetwork.com/diy.

* cited by examiner

MAGNETIC UTILITY KNIFE AND HOLDER

RELATED APPLICATION(S)

This Patent Application claims priority under 35 U.S.C. 119(e) of the co-pending U.S. Provisional Patent Application Ser. No. 61/819,278, filed May 3, 2013, and entitled "MAGNETIC UTILITY KNIFE AND HOLDER." The Provisional Patent Application Ser. No. 61/819,278, filed May 3, 2013, and entitled "MAGNETIC UTILITY KNIFE AND HOLDER" is also hereby incorporated by reference.

FIELD OF THE INVENTION

This invention relates generally to items incorporating magnets. More particularly, this invention relates to a hand tool comprising magnets and a holder for magnetically securing the hand tool.

BACKGROUND OF THE INVENTION

Small tools including, tape measures, levels, pliers, screw drivers, wrenches, utility knives and others are an integral part of the professional and amateur tool kit. In particular, many projects require multiple tools to be used interchangeably throughout the course of the project. Tools not being used are typically placed on a tool bench or table and near the user for later use. However, because the tools are not secured, they may roll off of the tool bench or table and away from the user. Consequently, the user must stop what they are doing to look for the tools and take their eyes away from the project. This often leads to inefficiencies and time delays as the user must look for the proper tool and then focus back on the project in front of them.

SUMMARY OF THE INVENTION

A utility knife comprises a body with a knife blade storable within the body and one or more magnets coupled to the knife body. The magnets are able to be embedded within the body or embedded with an adapter that is configured to removably couple with the utility knife. In some embodiments, the knife blade folds out from a side of the body and into an operable position. Alternatively, in some embodiments, the knife blade slides out of a top of the body and into the operable position. The utility knife is able to magnetically couple with a base comprising a magnetically attractable surface. In some embodiments, the utility knife is secured to the base in a vertical orientation. Alternatively, in some embodiments, the utility knife is secured to the base in a horizontal orientation.

In one aspect, a utility knife comprises a body, a knife blade storable within the body, and one or more magnets coupled to the body. In some embodiments, the one or more magnets are embedded within and raised from an exterior of the body. In further embodiments, the one or more magnets are embedded within an adapter that removably couples with the body. In some embodiments, the knife blade folds out from a side of the body and into an operable position. In further embodiments, the blade slides out from a top of the body and into an operable position. In some embodiments, a shape of the one or more magnets is selected from a set comprising a strip, a ball bearing and a disc. In further embodiments, at least one of the one or more magnets comprise one or more of a neodymium magnet and a ceramic magnet. In some embodiments, the one or more magnets are configured with interlocking geometry in order to removably couple with an interlocking base. In further embodiments, the one or more magnets are embedded within a raised surface of the body.

In another aspect, a system for securing a utility knife comprises a utility knife comprising a body, a knife blade storable within the body and one or more magnets coupled to the body and a base comprising a magnetically attractable surface and for removably coupling with the magnets of the utility knife. In some embodiments, the one or more magnets are embedded within and raised from an exterior of the body. In further embodiments, the one or more magnets are embedded within an adapter that removably couples with the body. In some embodiments, the knife blade folds out from a side of the body and into an operable position. In further embodiments, the blade slides out from a top of the body and into an operable position. In some embodiments, a shape of the one or more magnets is selected from a set comprising a strip, a ball bearing and a disc. In further embodiments, at least one of the one or more magnets comprise one or more of a neodymium magnet and a ceramic magnet. In some embodiments, the one or more magnets and the base are configured with interlocking geometry. In further embodiments, the one or more magnets are embedded within a raised surface of the body.

In a further aspect, a method of assembling a utility knife comprises providing a utility knife body, coupling a knife blade to the utility knife body, wherein the knife blade is storable within the body, and coupling one or more magnets to the body. In some embodiments, the one or more magnets are embedded within and raised from an exterior of the body. In further embodiments, the one or more magnets are embedded within an adapter that removably couples with the body. In some embodiments, the knife blade folds out from a side of the body and into an operable position. In further embodiments, the blade slides out from a top of the body and into an operable position.

DETAILED DESCRIPTION OF THE INVENTION

In the following description, numerous details are set forth for purpose of explanation. However, one of ordinary skill in the art will realize that the invention may be practiced without the use of these specific details or with equivalent alternatives. Thus, the presently claimed invention is not intended to be limited to the embodiments shown but is to be accorded the widest scope consistent with the principles and features described herein. Throughout the description similar components are similarly marked in order to aid comprehension.

Embodiments of the invention are directed to a utility knife comprising a knife blade storable within the body and one or more magnets coupled to the body. The utility knife is configured to removably couple with a securing base. The securing base comprises a magnetically attractable surface for removably coupling with the one or more magnets of the body. The securing base secures the utility knife in a convenient location when the utility knife is not being used. The utility knife is able to couple with the securing base in a vertical orientation and a horizontal orientation. The securing base is able to removably attach to an additional object such as the user's belt. Alternatively, the securing base is able to mount to an additional object such as a wall or tool box.

Figure 1:
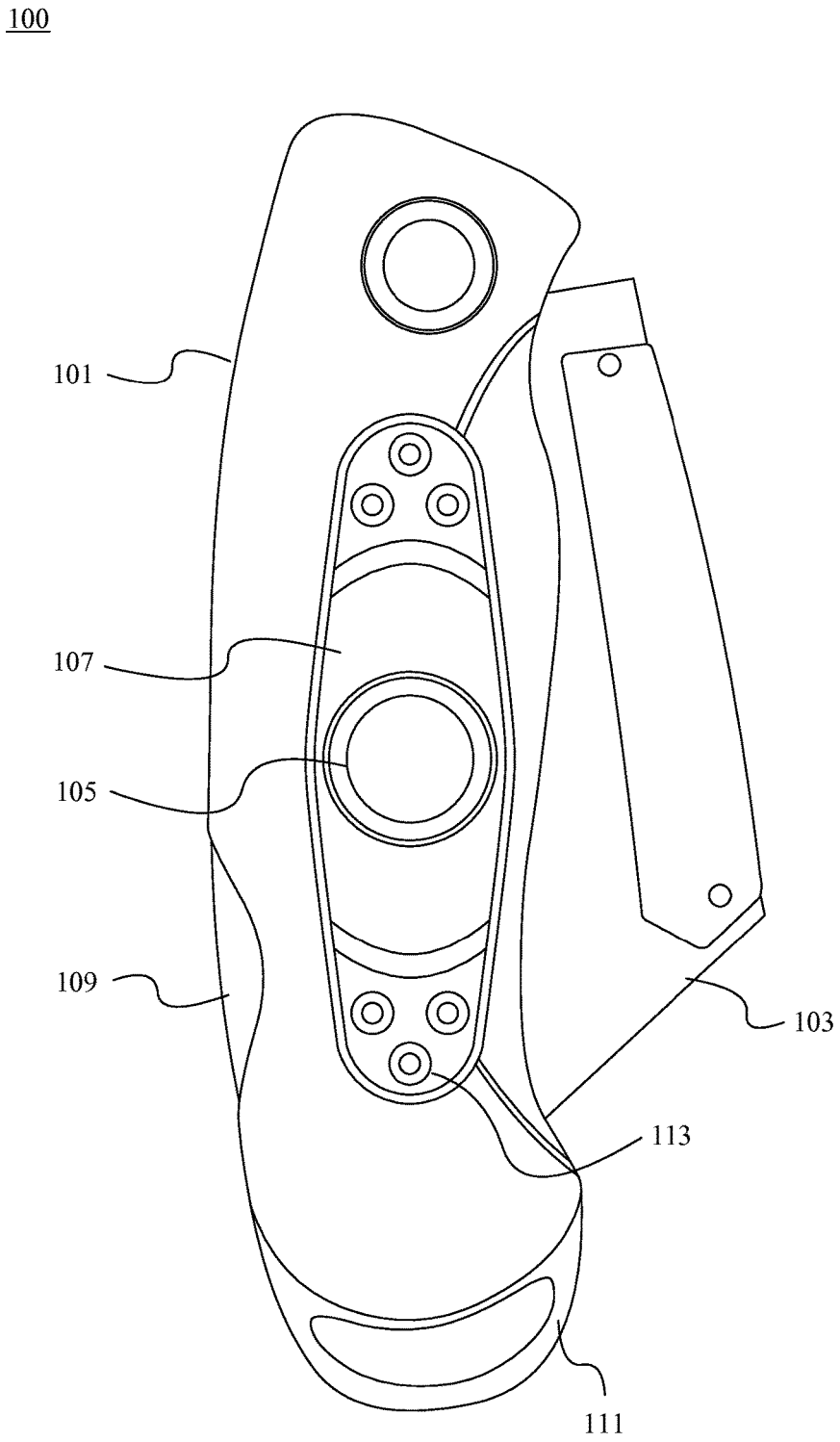
FIG. 1 illustrates a front view of a utility knife comprising one or more magnets in accordance with some embodiments.

Referring now to FIG. 1, a utility knife is shown therein. The utility knife 100 comprises a body 101, a knife blade 103 stored within the body, and one or more magnets 105 coupled to the body 101. In some embodiments, the utility knife 100 also comprises a lock release 109 and a hanging mechanism 111. The knife blade 103 is folded out from a side of the body 101 and into the operable cutting position. In some embodiments when the knife blade 103 is placed in the operable position it is locked and the lock release 109 must be depressed in order to fold the knife blade 103 back into the body and place it in the stored state.

In some embodiments, the one or more magnets 105 are embedded within and raised from an exterior of the body 101. In some embodiments, the one or more magnets 105 are embedded within and raised from a raised surface 107 of the body 101. Particularly, the one or more magnets 105 are embedded within a surface of the body 101 such that a portion of the one or magnets 105 is above and below the surface. For example, in some embodiments, the one or more magnets 105 are attached to the body 101 and the surface of the utility knife 100 is molded and/or manufactured around the one or more magnets 105. In some embodiments, the one or more magnets 105 are embedded within a plastic surface of the body 101. Alternatively, the one or more magnets 105 are embedded within a rubberized surface of the body 101. As will be apparent to someone of ordinary skill in the art, the one or more magnets 109 are able to be embedded in any portion of the body 101 of the utility knife 100. In some embodiments, the raised surface 107 and the one or more magnets 105 attach to the body 101 by one or more screws 113 in a top and/or a bottom of the raised surface 107 and the body 101. In some embodiments, the body 101 comprises molded EVA plastic. In some embodiments, the body 101 comprises one or more of metal, steel, plastic or a combination thereof. However, as will be apparent to someone of ordinary skill in the art, the body 101 is able to be manufactured in any appropriate configuration.

In some embodiments, at least one of the one or more magnets 105 comprises a neodymium magnet or a ceramic magnet. As will be evident to someone of ordinary skill in the art, the utility knife 100 is able to comprise any number and combination of magnets. For example, in some embodiments, the utility knife 100 comprises a plurality of magnets. In some embodiments, a shape of the one or more magnets 105 are selected from a set comprising a strip, a ball bearing and a disc.

The one or more magnets 105 of the utility knife 100 enable a user to removably couple the utility knife with a magnetically attractable surface when the utility knife 100 is not being used. For example, a user is able to removably couple the utility knife 100 with a nearby surface in order to free up space and remove clutter, while still keeping the utility knife 100 nearby. In some embodiments, a user is able to removably couple the utility knife 100 with a universal base such as described below.

Figure 2:
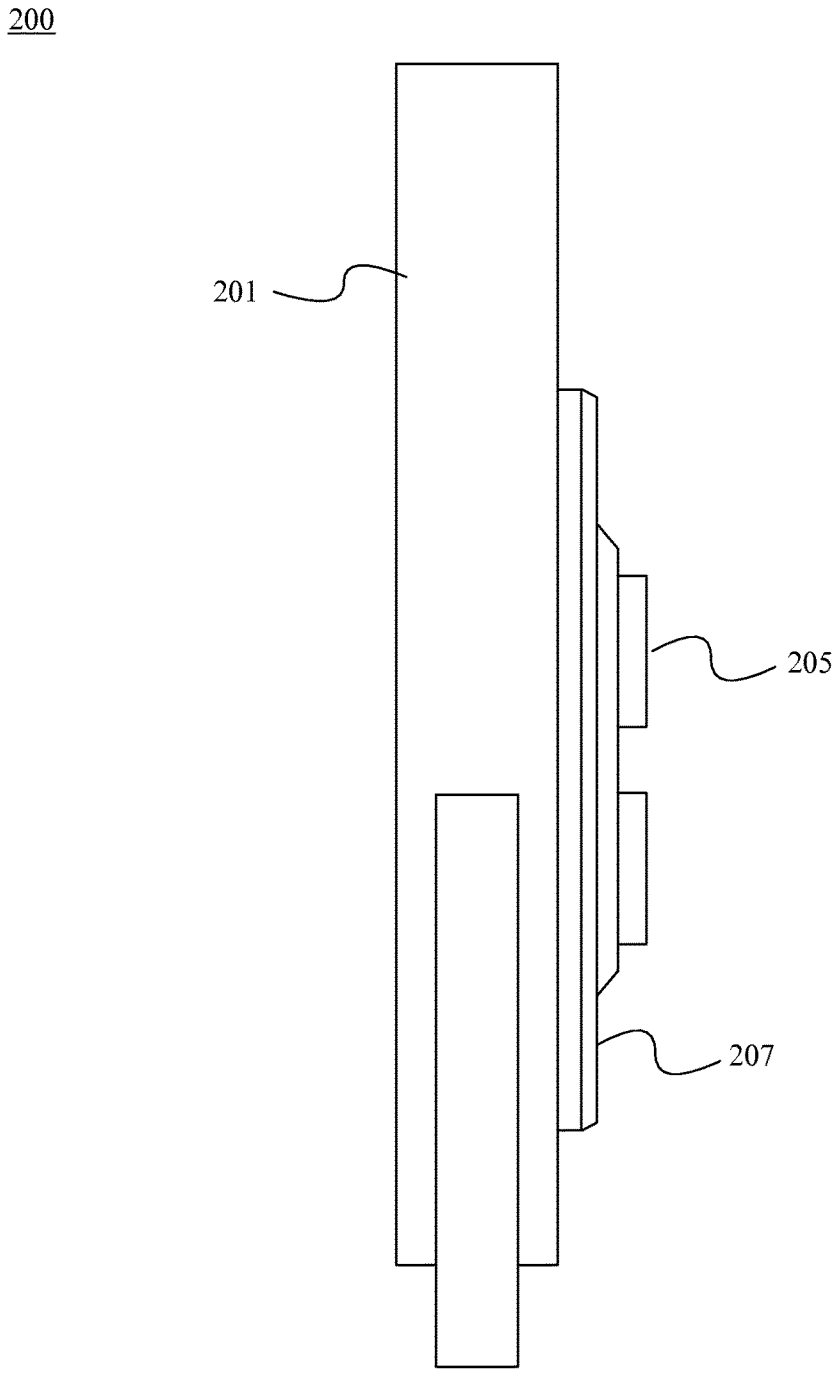
FIG. 2 illustrates a side view of a utility knife comprising one or more magnets in accordance with some embodiments.

FIG. 2 illustrates a side view of a utility knife comprising one or more magnets in accordance with some embodiments. The utility knife 200 comprises a body 201, a storable knife blade and one or more magnets 205 coupled to the body 201. As shown within FIG. 2, the one or more magnets 205 are coupled to the raised surface 207. In some embodiments, the one or more magnets 205 are embedded within the raised surface 207 such that a portion of each magnet is within the surface 207 and a portion of each magnet juts out from the surface 207. Alternatively, in some embodiments, the one or more magnets 205 are embedded within and raised from an exterior of the body 201. In some embodiments, the one or more magnets 205 are attached to an outside surface of the body 201. In further embodiments, the one or more magnets 205 are coupled to an adapter, which is configured to removably couple with a utility knife.

Figure 3A:
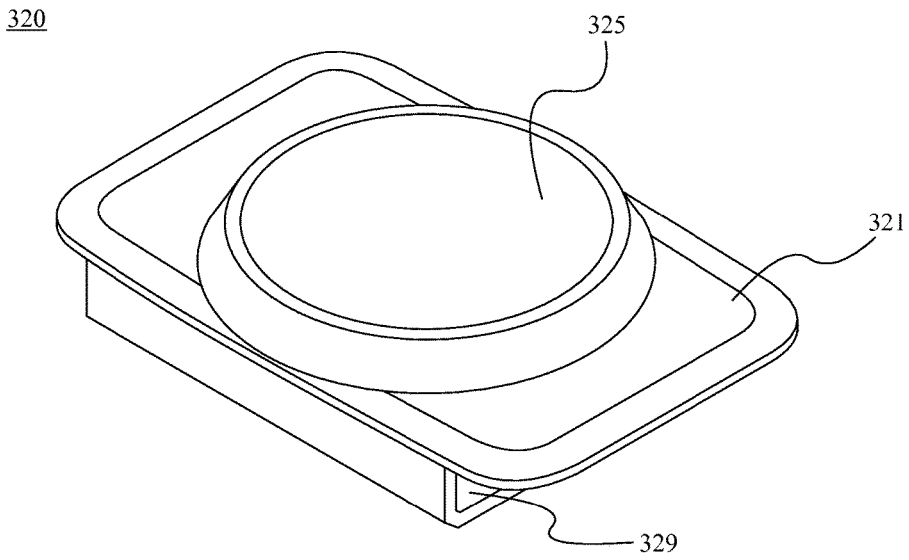
FIGS. 3A and 3B illustrate an adapter for a utility knife and comprising one or more magnets in accordance with some embodiments.
Figure 3B:
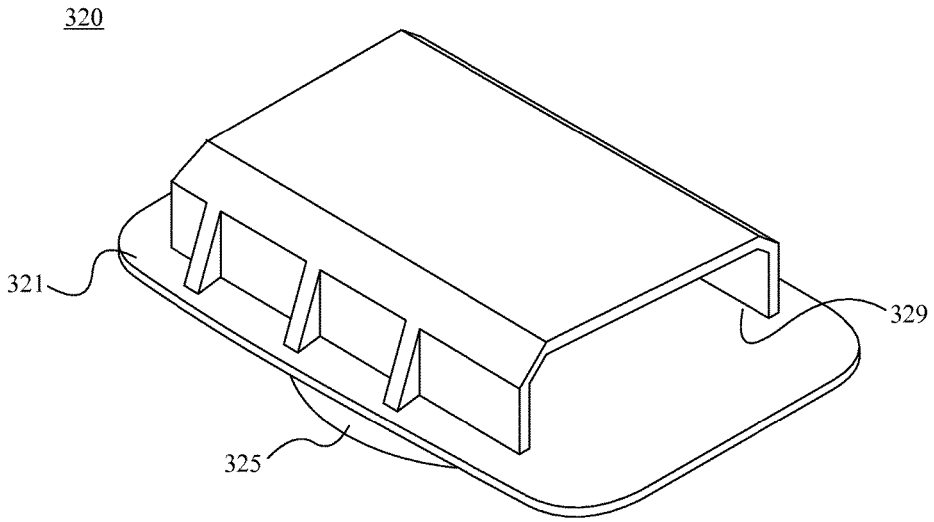

FIGS. 3A and 3B illustrate an adapter for removably coupling with a utility knife in accordance with some embodiments. The adapter 320 comprises an adapter body 321 and one or more magnets 325 coupled to the body 321. As shown within FIGS. 3A and 3B, the adapter 320 also comprises a through hole 329 for removably coupling with a utility knife. The one or more magnets 325 are shown embedded within and raised from an exterior surface of the body 321. However, the one or more magnets 325 are able to couple with the body 301 in any appropriate manner, as described above. In some embodiments, adapter 320 comprises molded EVA plastic. In some embodiments, the adapter 320 comprises one or more of metal and steel or a combination thereof. However, as will be apparent to someone of ordinary skill in the art, the adapter 320 is able to be manufactured in any appropriate configuration.

In some embodiments, at least one of the one or more magnets 325 comprises a neodymium magnet or a ceramic magnet. As will be evident to someone of ordinary skill in the art, the adapter 320 is able to comprise any number and combination of magnets. For example, in some embodiments, the adapter 320 comprises a plurality of magnets. In some embodiments, a shape of the one or more magnets 325 are selected from a set comprising a strip, a ball bearing and a disc.

Figure 4:
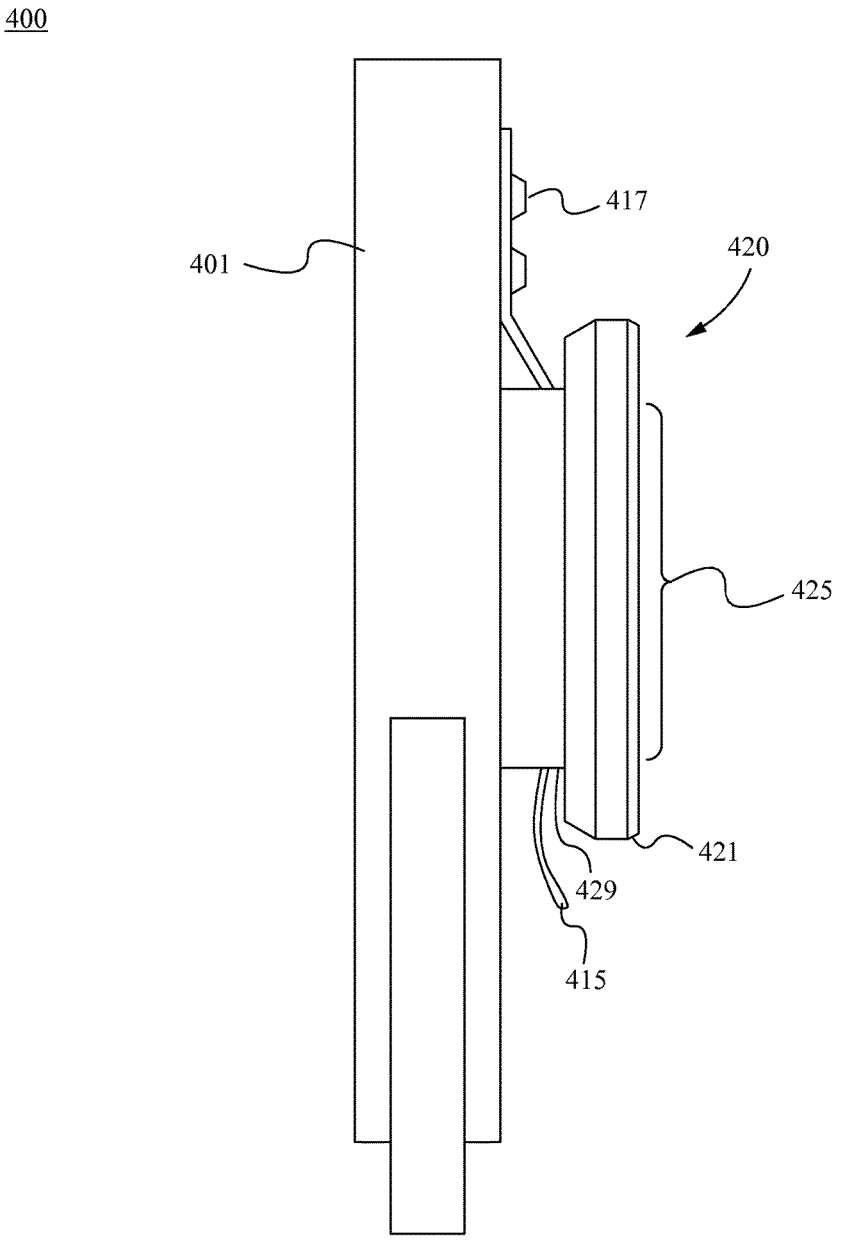
FIG. 4 illustrates a side view of a utility knife coupled with an adapter comprising one or more magnets in accordance with some embodiments.

FIG. 4 illustrates an adapter removably coupled with a utility knife in accordance with some embodiments. The adapter 420 has been coupled to the utility knife 401 by inserting the clip 415 of the utility knife 401 through the through hole 429 of the adapter 420. When the belt clip 415 is inserted through the through hole 429, the one or more magnets 425 face in an outward direction and away from the body 421 of the utility knife 401. Although the adapter 420 is shown coupled with the clip 415, in some embodiments, the adapter 420 couples with the utility knife 401 by removing the one or more screws 417 and screwing the adapter to the utility knife 401. As will be apparent to someone of ordinary skill in the art, the adapter 420 is able to couple with the utility knife 401 by any appropriate mechanism as known in the art.

The adapter 420 enables a user to add magnets to a previously non-magnetic utility knife and couple the utility knife with a magnetically attractable surface. Consequently, as described above, a user is able to removably couple the utility knife 100 with a nearby surface in order to free up space and remove clutter, while still keeping the utility knife 100 nearby. In some embodiments, a user is able to removably couple the utility knife 100 with a universal base such as described below.

Figure 5A:
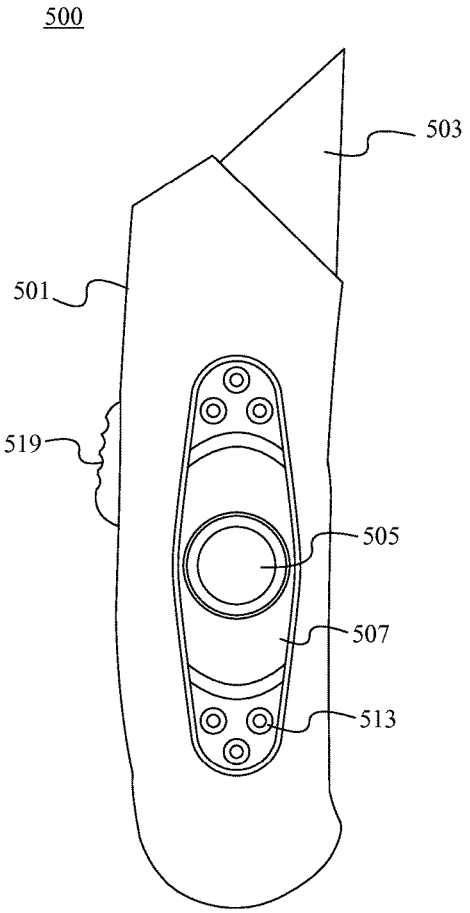
FIG. 5A illustrates a front view of a utility knife comprising one or more magnets in accordance with some embodiments.
Figure 5B:
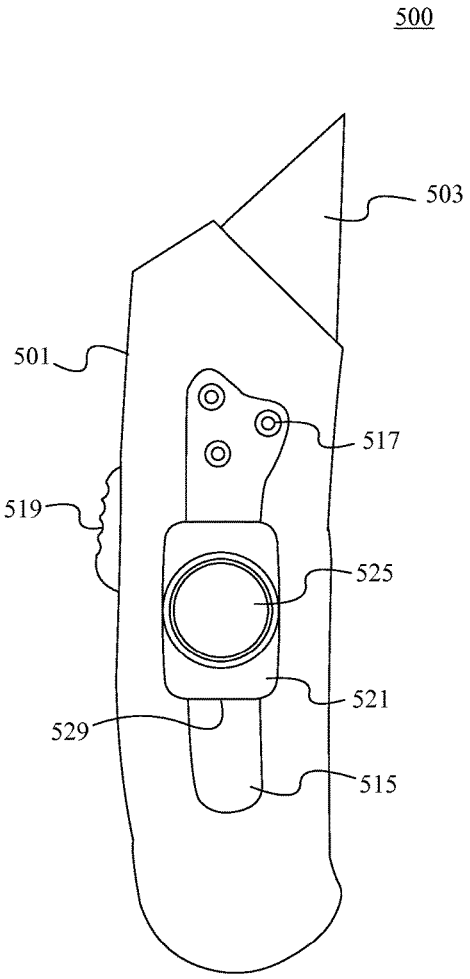
FIG. 5B illustrates a utility knife coupled with an adapter comprising one or more magnets in accordance with some embodiments.

FIGS. 5A and 5B illustrate a utility knife comprising one or more magnets in accordance with some embodiments.

As shown in FIG. 5A, the utility knife 500 comprises a body 501, a knife blade 503 storable within the body 501, and one or more magnets 505 coupled to the body 501. In order to move the knife blade 503 to the extended and operable position, the button 519 is depressed and slid upward in order to slidably push the blade 503 out from a top of the body 501. In some embodiments, when the knife blade 503 is slid to the operable position it is locked into place and the button 519 must be depressed in order to unlock the blade 503 and slide it back down in order to store the blade 503 within the body 501.

In some embodiments, the one or more magnets 505 are embedded within and raised from an exterior of the body 501. In some embodiments, the one or more magnets 505 are embedded within and raised from a raised surface 507 of the body 501. Particularly, the one or more magnets 505 are embedded within a surface of the body 501 such that a portion of the one or magnets 505 is above and below the surface. For example, in some embodiments, the one or more magnets 505 are attached to the body 501 and the surface of the utility knife 500 is molded and/or manufactured around the one or more magnets 505. In some embodiments, the one or more magnets 505 are embedded within a plastic surface of the body 501. Alternatively, the one or more magnets 505 are embedded within a rubberized surface of the body 501. As will be apparent to someone of ordinary skill in the art, the one or more magnets 505 are able to be embedded in any portion of the body 501 of the utility knife 500. In some embodiments, the raised surface 507 and the one or more magnets 505 attach to the body 501 by one or more screws 513 in a top and/or a bottom of the raised surface 507 and the body 501. In some embodiments, the body 501 comprises molded EVA plastic. In some embodiments, the body 501 comprises one or more of metal and steel or a combination thereof. However, as will be apparent to someone of ordinary skill in the art, the body 501 is able to be manufactured in any appropriate configuration.

In some embodiments, at least one of the one or more magnets 505 comprises a neodymium magnet or a ceramic magnet. As will be evident to someone of ordinary skill in the art, the utility knife 500 is able to comprise any number and combination of magnets. For example, in some embodiments, the utility knife 500 comprises a plurality of magnets. In some embodiments, a shape of the one or more magnets 505 is selected from a set comprising a strip, a ball bearing and a disc.

FIG. 5B illustrates an adapter, such as described above, removably coupled with a utility knife such as shown in FIG. 5A. The adapter 520 has been coupled to the utility knife 500 by inserting the clip 515 of the utility knife 500 through the through hole 529 of the adapter 520. When the belt clip 515 is inserted through the through hole 529, the one or more magnets 525 face in an outward direction and away from the body 521 of the utility knife 500. Although the adapter 520 is shown coupled with the clip 515, in some embodiments, the adapter 520 couples with the utility knife 500 by removing the one or more screws 517 and screwing the adapter to the utility knife 500. As will be apparent to someone of ordinary skill in the art, the adapter 520 is able to couple with the utility knife 500 by any appropriate mechanism as known in the art.

The adapter 520 comprises an adapter body 521 and one or more magnets 525 coupled to the body 521. As shown within FIGS. 5A and 5B, the adapter 520 also comprises a through hole 529 for removably coupling with a utility knife. The one or more magnets 525 are shown embedded within and raised from an exterior surface of the body 521. However, the one or more magnets 525 are able to couple with the body 501 in any appropriate manner, as described above. In some embodiments, adapter 520 comprises molded EVA plastic. In some embodiments, the adapter 520 comprises one or more of metal and steel or a combination thereof. However, as will be apparent to someone of ordinary skill in the art, the adapter 520 is able to be manufactured in any appropriate configuration.

In some embodiments, at least one of the one or more magnets 525 comprises a neodymium magnet or a ceramic magnet. As will be evident to someone of ordinary skill in the art, the adapter 520 is able to comprise any number and combination of magnets. For example, in some embodiments, the adapter 520 comprises a plurality of magnets. In some embodiments, a shape of the one or more magnets 525 are selected from a set comprising a strip, a ball bearing and a disc.

Figure 6A:
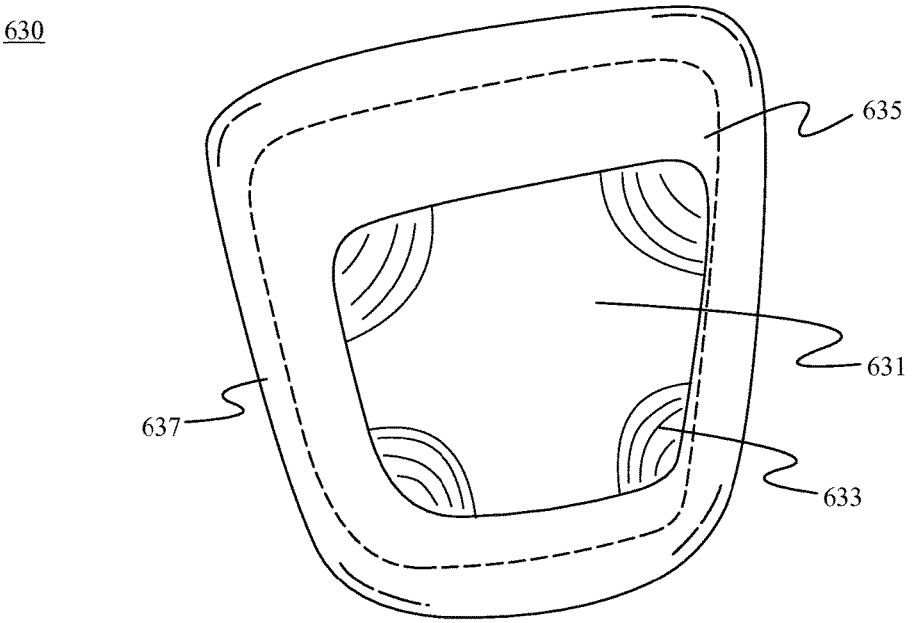
FIG. 6A illustrates a front view of a base for a utility knife in accordance with some embodiments.
Figure 6B:
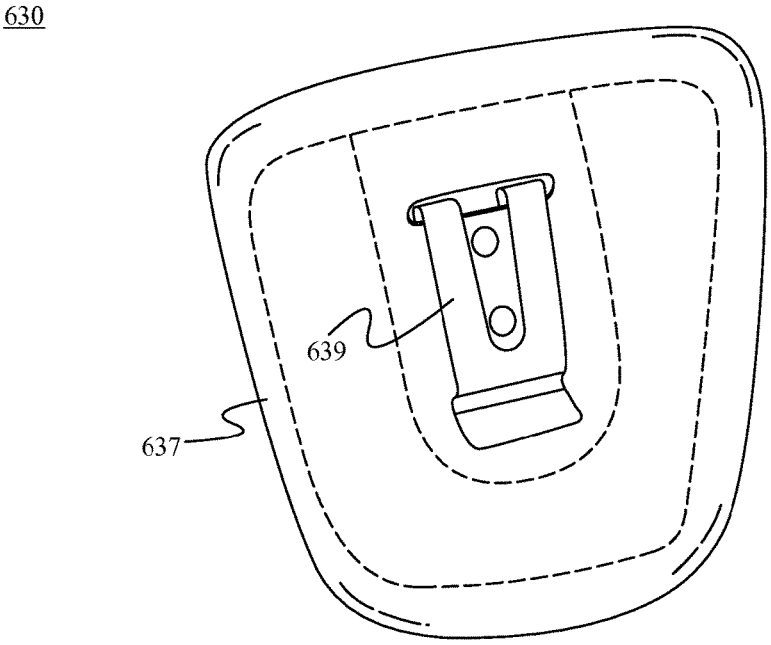
FIG. 6B illustrates a back view of a base for a utility knife in accordance with some embodiments.

FIGS. 6A and 6B illustrate a base for securing a utility knife in accordance with some embodiments. In some embodiments, the base is the same as the universal base as described in the co-owned U.S. patent application Ser. No. 13/379,702, which is hereby incorporated by reference. The base 630 comprises a surface 635, a binding 637, a magnetically attractable surface 631, and one or more securing corners 633. As shown in FIG. 6A, the base 630 comprises a +-shaped magnetically attractable surface and a plurality of plastic securing corners together forming a rectangular shape. In some embodiments, the magnetically attractable surface 631 comprises a metal surface and the one or more securing corners 633 comprise a plastic material. The one or more securing corners 633 secure the utility knife when it is coupled with the base 630. In some embodiments, the utility knife is securable in a vertical orientation and a horizontal orientation.

FIG. 6B shows a back view of a securing base 630 in accordance with some embodiments. In some embodiments, the securing base 630 comprises a clip 639 for removably coupling with an additional article such as a belt. However, the universal base 630 is able to couple with an additional article by any mechanism as known in the art. For example, in some embodiments, the universal base 630 couples to an additional article by one or more of magnets and a hook and loop fastening system. In some embodiments, the securing base 630 is mountable to an additional object.

Figure 7A:
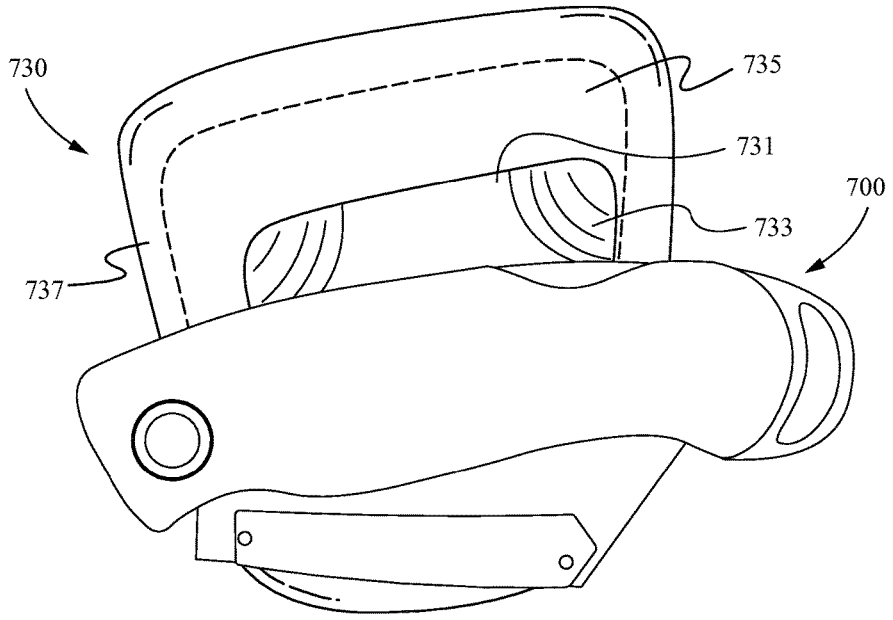
FIGS. 7A and 7B illustrate a utility knife coupled with a base in accordance with some embodiments.
Figure 7B:
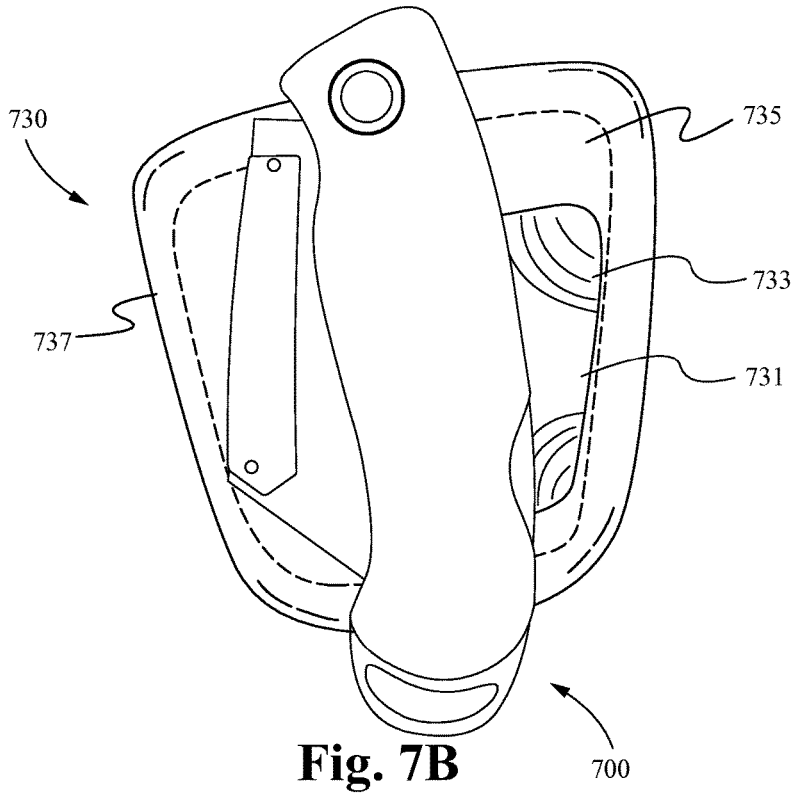

FIGS. 7A and 7B illustrate the operation of the base for securing a utility knife with a knife blade that it is folded out from a side of the body and into the operable cutting position.

The base 730 comprises a surface 735, a binding 737, a magnetically attractable surface 731, and one or more securing corners 733. When the base 730 is coupled with an additional item such as a belt, the magnetically attractable surface 731 and the one or more securing corners 733 face outward. A user is able to removably couple the one or more magnets of a utility and/or an adapter with the magnetically attractable surface 731. As shown within FIG. 7A, the utility knife 700 is removably coupled with the base 730 and secured in a horizontal orientation. In some embodiments, the base 730 comprises a +-shaped magnetically attractable surface and a plurality of plastic securing corners together forming a rectangular shape. Accordingly, when the utility knife 700 is coupled to the base 730 and secured in a horizontal orientation the one or more magnets of the utility knife are in a center of the magnetically attractable surface 731 and a top end and a bottom end of the utility knife 700 extend through an open space on the left side and the right side of the magnetically attractable surface 731 and in between the one or more securing corners 733. Similarly, in FIG. 7B, the utility knife 700 is removably coupled with the base 730 and secured in a vertical orientation. When the utility knife 700 is coupled to the base 730 and secured in a vertical orientation the one or more magnets of the utility knife 700 are in a center of the magnetically attractable surface 731 and a top end and a bottom end of the utility knife 700 extend through an open space on the top side and the bottom side of the magnetically attractable surface 731 and in between the one or more securing corners 733. As described above, in some embodiments, the base 730 comprises a single securing edge that completely surrounds the magnetically attractable surface 731. In these embodiments, the one or more magnets are secured in a center of the securing edge in a horizontal or a vertical orientation and the top end and bottom end of the utility knife 700 extend above the securing edge.

When the utility knife 700 is removably coupled with the base 730, the utility knife 700 is securely held in place and prevented from moving in a horizontal or a vertical direction by the interaction of the one or more magnets with the magnetically attractable surface 731 and the one or more securing corners 733. In some embodiments, the utility knife 700 and the base 730 comprise interlocking geometry. For example, in some embodiments, when the utility knife 700 is coupled with the base 730, the one or more magnets removably couple with the magnetically attractable surface 731 and the raised surface of the body 701 is held by the one or more securing corners 733. Consequently, when the utility knife 700 is removably coupled with the base 730, the utility knife 700, is secured by two separate mechanisms. Thus, in order to remove the utility knife 700 from the base 730, the one or more magnets are removed from the magnetically attractable surface 731 and the utility knife 700 is separated from the one or more securing corners 733.

Figure 8A:
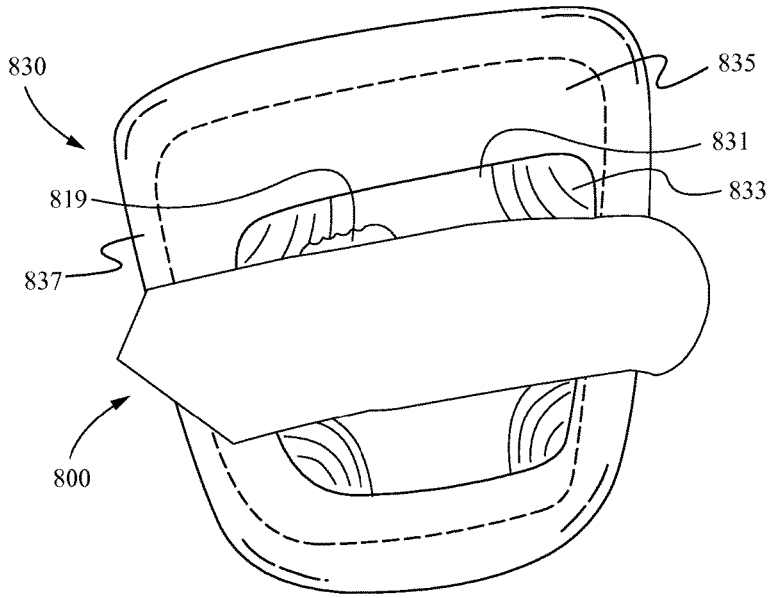
FIGS. 8A and 8B illustrate a utility knife coupled with a base in accordance with some embodiments.
Figure 8B:
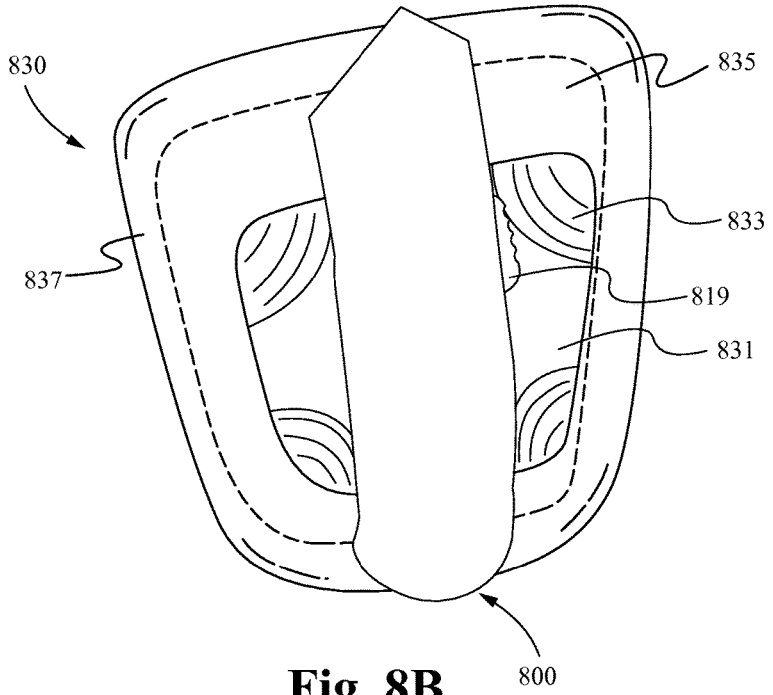

FIGS. 8A and 8B illustrate the operation of the base for securing a utility knife comprising a button that it is slid upward in order to slidably push the blade out from a top of the body and into the operable cutting position.

The base 830 comprises a surface 835, a binding 837, a magnetically attractable surface 831, and one or more securing corners 833. When the base 830 is coupled with an additional item such as a belt, the magnetically attractable surface 831 and the one or more securing corners 833 face outward. A user is able to removably couple the one or more magnets of a utility and/or an adapter with the magnetically attractable surface 831. As shown within FIG. 8A, the utility knife 800 is removably coupled with the base 830 and secured in a horizontal orientation. As described above, in some embodiments, the one or more securing corners 833 are each located at a corner of the magnetically attractable surface 831. Accordingly, when the utility knife 800 is coupled to the base 830 and secured in a horizontal orientation the one or more magnets of the utility knife are in a center of the magnetically attractable surface 831 and a top end and a bottom end of the utility knife 800 extend through an open space on the left side and the right side of the magnetically attractable surface 831 and in between the one or more securing corners 833. Similarly, in FIG. 8B, the utility knife 800 is removably coupled with the base 830 and secured in a vertical orientation. When the utility knife 800 is coupled to the base 830 and secured in a vertical orientation the one or more magnets of the utility knife 800 are in a center of the magnetically attractable surface 831 and a top end and a bottom end of the utility knife 800 extend through an open space on the top side and the bottom side of the magnetically attractable surface 831 and in between the one or more securing corners 833. As described above, in some embodiments, the base 830 comprises a single securing edge that completely surrounds the magnetically attractable surface 831. In these embodiments, the one or more magnets are secured in a center of the securing edge in a horizontal or a vertical orientation and the top end and bottom end of the utility knife 800 extend above the securing edge.

When the utility knife 800 is removably coupled with the base 830, the utility knife 800 is securely held in place and prevented from moving in a horizontal or a vertical direction by the interaction of the one or more magnets with the magnetically attractable surface 831 and the one or more securing edges. In some embodiments, the utility knife 800 and the base 830 comprise interlocking geometry. For example, in some embodiments, when the utility knife 800 is coupled with the base 830, the one or more magnets removably couple with the magnetically attractable surface 831 and the raised surface of the body 801 is held by the one or more securing edges 833. Consequently, when the utility knife 800 is removably coupled with the base 830, the utility knife 800, is secured by two separate mechanisms. Thus, in order to remove the utility knife 800 from the base 830, the one or more magnets are removed from the magnetically attractable surface 331 and the utility knife 800 is separated from the one or more securing corners 833.

When using the utility knife, a user is able to couple the utility knife with a magnetically attractable surface. For example, the user is able to couple the utility knife with the magnetically attractable surface by using the one or more magnets of the utility knife. Alternatively, a user first couples an adapter to the utility knife and couples the utility knife with the magnetically attractable surface by using the one or more magnets of the adapter. This enables a user to removably couple the utility knife with a variety of items including a tool box, steel beam, or other magnetically attractable surface. Alternatively, the utility knife removably couples with a base which is clipped or attached to another object. In either case, a user is able to keep the utility knife in a known place and within close reach while working. Additionally, because in some embodiments, the one or more magnets are embedded within and raised from an exterior surface of the body, the utility knife is able to securely attach to a magnetically attractable surface without interference from the body or other aspect of the utility knife. Moreover, because the one or more magnets are molded into and/or embedded within the body, powerful neodymium and/or ceramic magnets are able to be used in order to securely hold and couple the utility knife with the magnetically attractable surface.

Figure 9:
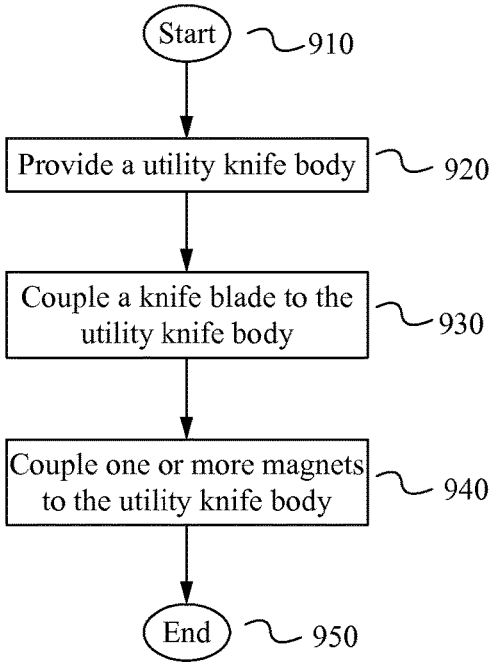
FIG. 9 illustrates a method of assembling a utility knife in accordance with some embodiments.

FIG. 9 illustrates a method for assembling a utility knife in accordance with some embodiments. The method begins in the step 910. In the step 920, a utility knife body is provided. In the step 930, a knife blade is coupled to the body. The knife blade is storable within the utility knife body. In some embodiments, the knife blade is coupled with the body such that it is folded out from a side of the body and into the operable cutting position. In some embodiments, the knife blade is coupled with the body such that it is slid upward in order to slidably push the blade out from a top of the body and into the operable position. In the step 940 one or more magnets are coupled to the utility knife body. In some embodiments, the one or more magnets are embedded within and raised from an exterior of the body. Alternatively, in some embodiments, the one or more magnets are embedded within an adapter that removably couples with the body. The one or more magnets of the utility knife enable a user to removably couple the utility knife with a magnetically attractable surface and/or a base with a magnetically attractable surface when the utility knife is not being used. For example, a user is able to removably couple the utility knife with a nearby magnetically attractable surface in order to free up space and remove clutter, while still keeping the utility knife nearby. In the step 950, the method ends.

Using a utility knife comprising magnets in conjunction with the base enables a user to keep the utility knife near to the user for easy access and use. For example, a user is able to clip the base to the user's belt and secure the utility knife in a horizontal or a vertical configuration. Then, when the utility knife is needed it is removed from the base without an unneeded search and without having to move from the workspace. Particularly, the magnetic utility knife and holder enables a user to freely complete a work project without misplacing the utility knife cluttering the work area. Further, because the utility knife is coupled to the base in a horizontal or vertical orientation, the user is able to secure the utility knife in the most comfortable and convenient manner.

When the utility knife is coupled with the base, the utility knife is closely and securely held a by two separate mechanisms. In one instance, the utility knife is securely held by the base due to the attraction of the one or more magnets of the holder with a magnetically attractable surface of the base. As described above, in some embodiments, the utility knife is also secured by the interlocking geometry of the body and the base. Further, by incorporating magnets directly with an outer body of the utility knife, it is able to couple with a magnetically attractable surface without additional modification. Alternatively, if the utility knife does not incorporate magnets, the utility knife is able to be coupled with an adapter incorporating magnets within its outer body and then coupled with a magnetically attractable surface. Thus, the magnetic utility knife and holder and outer body as described above have many advantages.

The invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications area able to be made in the embodiment chosen for illustration without departing from the spirit and scope of the invention. Specifically, it will be apparent that the design for the utility knife and holder is able to be implemented with many different tool holders as known in the art. Further, it will be apparent to one of ordinary skill in the art that the precise structure of the device is able to be substantially varied to accommodate various magnetically attractable materials and configurations of magnets. Consequently, the claims should be broadly construed, consistent with the spirit and scope of the invention, and should not be limited to their exact, literal meaning.

I claim:

1. A utility knife in combination with a base, The utility knife comprising:

a. a body;

b. an elongated raised surface extending from a side of the body;

c. a knife blade storable within the body; and d. one or more body magnets embedded within and raised from the elongated raised surface extending from the side of the body;

the base comprising a +-shaped magnetically attractable surface and a plurality of plastic corners together forming a rectangular shape, wherein the one or more body magnets of the utility knife are able to removably couple with the +-shaped magnetically attractable surface thereby allowing the utility knife to removably couple with the base.

2. The utility knife of claim 1 wherein the knife blade folds out from a side of the body and into an operable position.

3. The utility knife of claim 1 wherein the knife blade slides out from a top of the body and into an operable position.

4. The utility knife of claim 1 wherein a shape of the one or more body magnets comprises a disc.

5. The utility knife of claim 1 wherein at least one of the one or more body magnets comprise one or more of a neodymium magnet and a ceramic magnet.

6. The utility knife of claim 1 wherein the body comprises a first end and a second end which extend beyond the +-shaped magnetically attractable surface when the utility knife is coupled to the base.

7. A system for securing a utility knife comprising:

a. a utility knife comprising:

i. a body;

ii. an elongated raised surface extending from a side of the body;

iii. a knife blade storable within the body; and iv. one or more body magnets embedded within the elongated raised surface extending from the side of the body; and b. a base comprising a +-shaped magnetically attractable surface and a plurality of plastic securing corners together forming a rectangular shape, wherein the one or more body magnets of the utility knife are able to be removably coupled with the +-shaped magnetically attractable surface.

8. The system of claim 7 wherein the knife blade folds out from a side of the body and into an operable position.

9. The system of claim 7 wherein the knife blade slides out from a top of the body and into an operable position.

10. The system of claim 7 wherein a shape of the one or more body magnets comprises a disc.

11. The system of claim 7 wherein at least one of the one or more body magnets comprise one or more of a neodymium magnet and a ceramic magnet.

12. The system of claim 7 wherein the body comprises a first end and a second end which extend beyond the +-shaped magnetically attractable surface when the one or more body magnets are coupled to the +-shaped magnetically attractable surface.

13. A method of assembling a utility knife and base comprising:

a. providing a utility knife body;

b. coupling an elongated raised surface with the body, wherein the elongated raised surface extends from the body;

c. coupling a knife blade to the utility knife body, wherein the knife blade is storable within the body;

d. embedding one or more body magnets within the elongated raised surface of the body, wherein the one or more body magnets are embedded within and raised from the elongated raised surface to extend from the side of the body; and e. removably coupling the utility knife to the base which comprises a +-shaped magnetically attractable surface and a plurality of plastic securing corners together forming a rectangular shape, wherein the one or more body magnets of the utility knife are able to be removably coupled with the +-shaped magnetically attractable surface.

14. The method of claim 13 wherein the knife blade folds out from a side of the utility knife body and into an operable position.

15. The method of claim 13 wherein the knife blade slides out from a top of the body and into an operable position.

16. The method of claim 13 wherein the utility knife body comprises a first end and a second end which extend beyond the +-shaped magnetically attractable surface when the one or more body magnets are coupled to the +-shaped magnetically attractable surface.

* * * * *